United States Patent [19]

Euler

[11] 4,027,967

[45] June 7, 1977

[54] APPARATUS FOR CONNECTING A MOVING PHOTOCONDUCTIVE WEB WITH A FIXED ELECTRIC POTENTIAL

[75] Inventor: Reinhold Euler, Kelkheim, Taunus, Germany

[73] Assignee: Hoechst Aktiengesellschaft, Frankfurt, Germany

[22] Filed: Aug. 2, 1974

[21] Appl. No.: 494,303

Related U.S. Application Data

[63] Continuation of Ser. No. 329,562, Feb. 5, 1973, abandoned.

[30] Foreign Application Priority Data

Feb. 7, 1972 Germany ..... 2205601
Feb. 24, 1972 Netherlands ..... 7202437

[52] U.S. Cl. ..... 355/16; 310/253
[51] Int. Cl.[2] ..... G03G 15/00
[58] Field of Search ..... 355/3–17; 310/6, 253, 247, 249, 251

[56] References Cited

UNITED STATES PATENTS

| | | | |
|---|---|---|---|
| 3,023,731 | 3/1962 | Schwartz | 355/16 X |
| 3,146,688 | 9/1964 | Clark et al. | 355/11 |
| 3,284,371 | 11/1966 | Krellner | 310/253 X |
| 3,339,469 | 9/1967 | McFarlane | 355/16 |
| 3,345,448 | 10/1967 | Malkin | 310/253 X |
| 3,469,118 | 9/1969 | Herb et al. | 310/6 |
| 3,534,206 | 10/1970 | Carey | 310/249 |
| 3,625,604 | 12/1971 | Pressman | 355/16 X |
| 3,694,068 | 9/1972 | Jordon | 355/16 X |
| 3,713,736 | 1/1973 | Sargis | 355/3 X |

FOREIGN PATENTS OR APPLICATIONS 1,141,474 1/1969 United Kingdom

OTHER PUBLICATIONS

IBM Tech. Discl. Bull.; Grannis & Libby, "Grounding Scheme for Moving Photoconductor"; vol. 13, No. 2, p. 1660; Nov. 1970.

*Primary Examiner*—L. T. Hix
*Assistant Examiner*—J. A. LaBarre
*Attorney, Agent, or Firm*—Stevens, Davis, Miller & Mosher

[57] ABSTRACT

An electrophotographic apparatus having a movable web of plastic material on which is disposed a vapor-deposited conductive layer and a photoconductor layer. The conductive layer is in slidable contact with a fixed potential stationary electrical contact having a graphite surface.

3 Claims, 3 Drawing Figures

Figure 1:
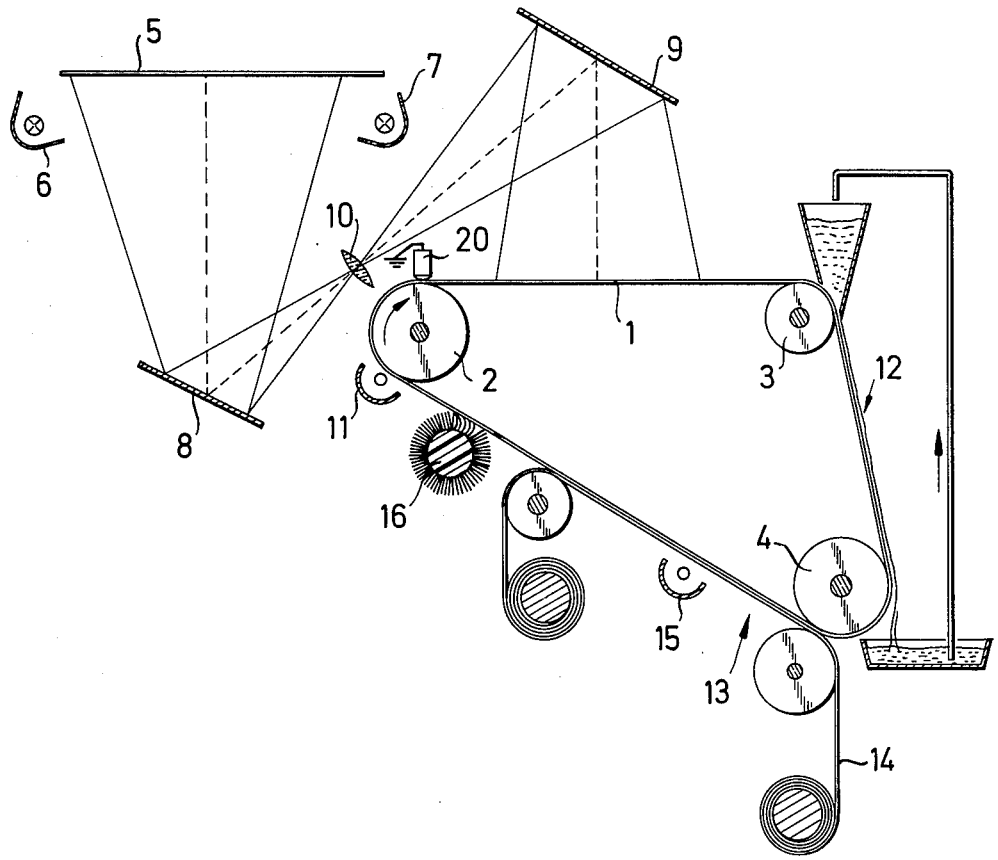

APPARATUS FOR CONNECTING A MOVING PHOTOCONDUCTIVE WEB WITH A FIXED ELECTRIC POTENTIAL

This is a continuation of application Ser. No. 329,562, filed Feb. 5, 1973, now abandoned.

This invention relates to electrophotographic apparatus, and more particularly to electrophotographic apparatus in which a photoconductor is movable past various electrophotographic stations. The photoconductor has an insulating support web with, in turn, an electrically conductive layer, and a photoconductive layer disposed thereon, in which there is or can be an electrical connection between the electrically conductive layer and a stationary contact at a fixed potential.

In the field of electrophotographic reproduction increasing use today is being made of photoconductors that consist not of a rigid metal roller having a photoconductive material disposed thereon but of a flexible web comprising a support, a conductive layer and a photoconductive layer. If such photoconductors are not disposed on drums, but are used in the form of continuous webs which are conveyed, for example, by several guide rollers, there is some difficulty in bringing the electrically conductive layer of this photoconductor into electrical contact with a fixed potential elsewhere on the apparatus. This electrical contact must be reliable and good, and at the same time must not destroy the very thin metal layer during the working life of the photoconductor.

Numerous attempts already have been made to achieve this, including an attempt to produce the contact by rolling and not sliding. In this case too, however, the electrically conductive layer was destroyed long before the photoconductor was worn out. The use of metallic conductive brushes have also resulted in a very rapid destruction of the electrically conductive layer.

The present invention provides electrophotographic apparatus having a photoconductor disposed on a movable web having an electrically conductive layer which is to be electrically connected to a fixed potential elsewhere on the apparatus, wherein the electrical connection is made between the electrically conductive layer and a contact having a stationary graphite surface.

This sliding contact not only permits an excellent and very good electrical connection for the metal layer between stationary and movable parts, but also offers the additional advantage that even if cracks occur in the electrically conductive layer, reliable operation of the apparatus is still possible. It is assumed that if such cracks occur, the resulting cavities are filled with graphite, causing electrical bridging of the cracks. We have established that in this type of electrical connection between the electrically conductive layer and the fixed potential the life span of the electrically conductive layer can greatly exceed that of the photoconductor.

The sliding contact is particularly easy to produce if there is used, as slider, graphite produced by coking (which is preferred) a carbon filament felt, or polytetrafluoroethylene fibers spun-dyed with carbon black.

In order to achieve a particularly soft contact it is preferably to form the actual sliding element as a resilient pad, the outside of which bears the graphite layer. In this case the pad can consist entirely of a carbon filament felt, but a foam cushion coated with a graphite tissue also can be used.

Figure 2:
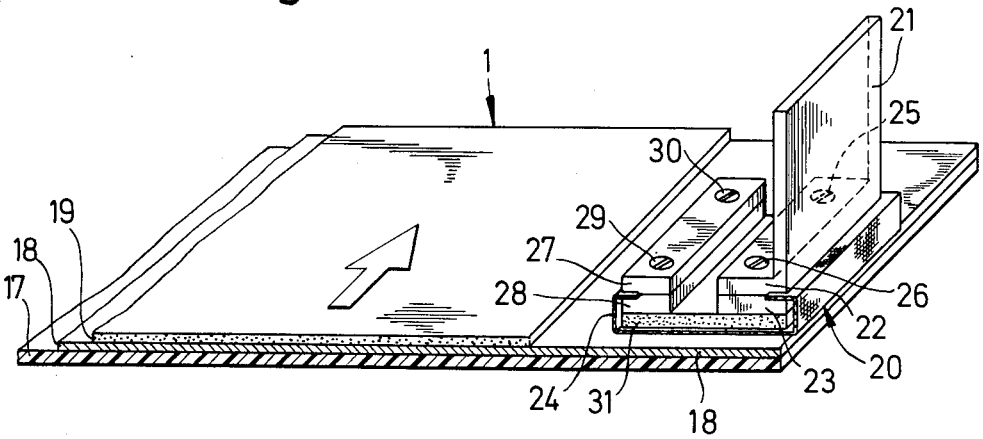
Figure 3:
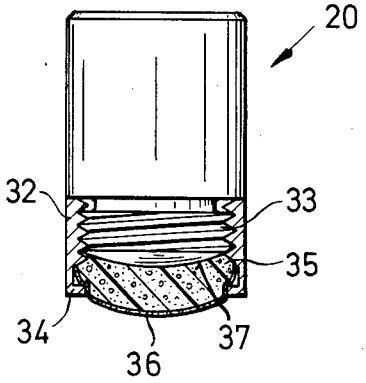

The invention will now be described in greater detail, by way of example only, with reference to the accompanying drawings, in which FIG. 1 is a section through an electrophotographic reproduction apparatus;

FIG. 2 is a perspective dissected representation of the photoconductor and the sliding contact of the invention; and FIG. 3 is a second embodiment of the sliding contact of the invention.

In the apparatus represented schematically in FIG. 1, a continuous photoconductor web 1 runs over three guide rollers 2, 3 and 4. From an original 5, a laterally-inverted image is produced on the photoconductor 1 with the assistance of flash lamps 6 and 7 via two mirrors 8 and 9 and an optical system 10. The photoconductor is uniformly charged by the corona 11 and in the flash exposure a charge pattern corresponding to the original 5 is produced on the photoconductor. This charge pattern is subsequently developed in a developing station 12 between the rollers 2 and 4, for example, by means of a cascade development station.

The developed image on the photoconductor 1 is transferred by a transfer station 13 onto a copy receiving material 14, for example, paper, using, for example, a transfer corona 15. If necessary, the photoconductor is cleaned of residual toner by means of a cleaning brush 16. Subsequently the described cycle may be repeated.

The photoconductor 1 consists — as is schematically illustrated and somewhat exaggerated in FIG. 2 — of a carrier foil 17, for example, a strip of plastics material, onto which is vapor-deposited a conductive layer 18, for example of aluminum. Disposed on the electrically conductive layer 18 is a photoconductor layer 19. For a charge pattern to be formed on the photoconductor layer 19 on exposure to light, the conductive layer 18 must be maintained at a particular potential, usually earth. For this purpose, it is necessary for an electrical connection to be maintained between the layer 18 and the fixed potential. A connection to earth of only one of the rollers 2, 3 or 4 by means of a lock is impossible since the belt runs round each of the three rollers.

A sliding contact 20 has an L-shaped flange 21 rigidly attachable to the electrophotographic apparatus, a clamping plate 23 being screwed to its foot 22 which is elongated in the direction of travel of the photoconductor 1. One edge of a piece of graphite tissue 24 is clamped between the foot 22 and the plate 23 by means of the screws 25 and 26. Two further metal parts 27 and 28 are also provided, parallel to and spaced from the foot 22. The graphite tissue passes underneath plate 23 and foam cushion 31 positioned between the plate members 23 and 28 and has its other edge clamped to plate 28 by means of screws 29 and 30. The two plate members 27 and 28 also form a weight for pressing the graphite tissue 24 on the vapor-deposited aluminum layer 18. The sliding contact is made softer and more resilient by means of the foam member 31.

A second embodiment of the sliding contact of the invention is represented schematically in FIG. 3. In this case the sliding contact 20 consists of a holder 32 into which is screwed a plug. At the lower end 34 of the holder 32 there is inserted a piece of foam rubber 35 with graphite tissue 36, or alternatively a piece of carbon filament, attached. A screw insert 33 is so shaped that it does not stop short of the insert 35, 36 when it is fully screwed into the holder 32, but swells out the insert to some extent, with its convex front end, so that the graphite material 36 projects beyond the end 34 of the holder 32. This graphite material 36 comes into contact, during operation, with the vapor-deposited aluminum layer 18.

Excellent results are achieved with a graphite tissue produced by coking and marketed under the material description TGM 285 by Deutsche Carbone AG., Frankfurt/Main. This contact material is preferred. Also suitable is a carbon filament felt marketed by Sigri Elektrographit GmbH, 8901 Meitingen/Augsburg, under the name Sigrathern, and Hostaflon fibers spun-dyed with carbon black by Farbwerke Hoechst AG., Frankfurt (Main).

What is claimed is:

1. An electrophotographic apparatus comprising a corona charge device, a web movable past said corona charge device, an electrically conductive layer disposed on said web, a photoconductive layer disposed on said electrically conductive layer, a stationary contact electrically connectable to a fixed electrical potential and slidably in contact with said electrically conductive layer, said stationary contact consisting of a carbon layer in contact with said electrically conductive layer, a first and second part between which the carbon layer is elastically supported, a foam cushion and two plate members each of which is attached to one of said parts, said first part of said stationary contact being L-shaped and said second part being spaced from and parallel to the foot of said L-shaped part, said second part and said foot being elongated in the direction of travel of the insulating web, each plate member facing the foam cushion positioned underneath said members.

2. The electrophotographic apparatus as claimed in claim 1, wherein the carbon layer is a piece of graphite tissue, one edge of which is disposed between the foot of the L-shaped first part and its matching plate member, said first part and its matching plate member being screwed together, and wherein the other edge of said piece of graphite tissue is disposed between the second part of the stationary contact and its matching plate member, which are screwed together.

3. The electrophotographic apparatus as claimed in claim 2, wherein said foam cushion is positioned between the undersides of the matching plate members to the first and second parts of the stationary contact and the piece of graphite tissue.

* * * * *

UNITED STATES PATENT AND TRADEMARK OFFICE

CERTIFICATE OF CORRECTION

PATENT NO. : 4,027,967

DATED : June 7, 1977

INVENTOR(S) : Reinhold EULER

It is certified that error appears in the above-identified patent and that said Letters Patent are hereby corrected as shown below:

[56] References Cited, line 1, "Schwartz" should be -- Schwertz --
line 6, second column,
"Jordon" should be -- Jordan --

Column 2, line 23, "rollers 2 and 4" should be
-- rollers 3 and 4 --.

Column 3, line 14, should be, -- under the name Sigrathern®,
and Hostaflon® fibers spun- --.

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*